US008870619B1

(12) United States Patent
Morgan et al.

(10) Patent No.: US 8,870,619 B1
(45) Date of Patent: Oct. 28, 2014

(54) SURF DISC SYSTEM

(75) Inventors: Michael Morgan, Laguna Beach, CA (US); Michael Thomas Clark, Aguanga, CA (US)

(73) Assignee: Shoreline Toys, Inc., Laguna Beach, CA (US)

( * ) Notice: Subject to any disclaimer, the term of this patent is extended or adjusted under 35 U.S.C. 154(b) by 218 days.

(21) Appl. No.: 13/368,757

(22) Filed: Feb. 8, 2012

(51) Int. Cl.
*A63H 27/00* (2006.01)

(52) U.S. Cl.
USPC ..... 446/46

(58) Field of Classification Search
CPC ..... A63H 33/18; A63H 27/00; A63H 33/22; A63B 65/10; A63B 67/00; A63B 59/025; A63B 67/06; A01K 15/025; B65D 81/36; B63B 1/041; B63B 35/81; B63B 35/7906; B63B 35/7973
USPC ..... 441/74; 473/588; 446/46, 47, 48
See application file for complete search history.

(56) References Cited

U.S. PATENT DOCUMENTS

| | | | | | |
|---|---|---|---|---|---|
| 4,114,885 | A * | 9/1978 | Morrow | 473/588 |
| 4,212,462 | A * | 7/1980 | Glovak et al. | 473/588 |
| 4,378,653 | A * | 4/1983 | O'Brien | 446/46 |
| 4,463,954 | A * | 8/1984 | Panse et al. | 473/588 |
| 4,979,922 | A * | 12/1990 | Clark | 446/46 |
| 5,433,637 | A * | 7/1995 | Graves | 441/80 |
| 5,679,082 | A * | 10/1997 | Hincke | 473/588 |
| 5,836,480 | A * | 11/1998 | Epp et al. | 222/143 |
| 6,604,742 | B2 * | 8/2003 | El Sabbagh | 273/348.4 |
| 7,424,866 | B1 * | 9/2008 | Tsengas | 119/707 |
| 7,513,220 | B2 * | 4/2009 | Ragonetti et al. | 119/707 |

* cited by examiner

*Primary Examiner* — Stephen Avila
*Assistant Examiner* — Anthony Wiest

(57) ABSTRACT

A surf disc has a planar bottom surface and parallel top surface with an upwardly extending hemispherical dome. An annular thumb recess is formed in the top surface and a frusto-conical rocker is formed in the bottom surface.

1 Claim, 3 Drawing Sheets

FIG. 1
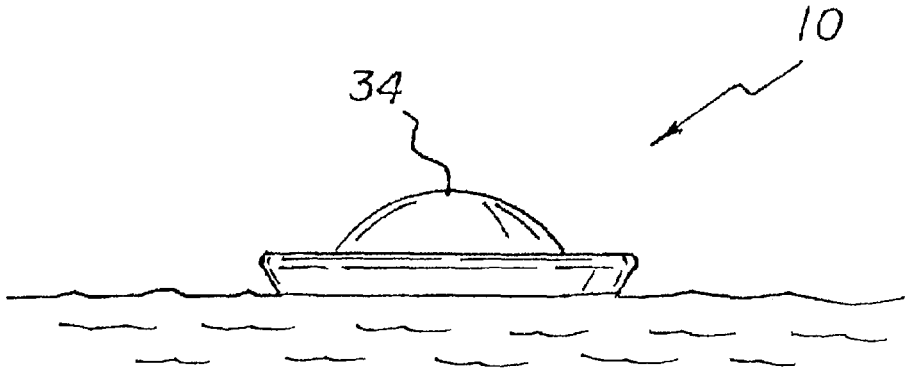
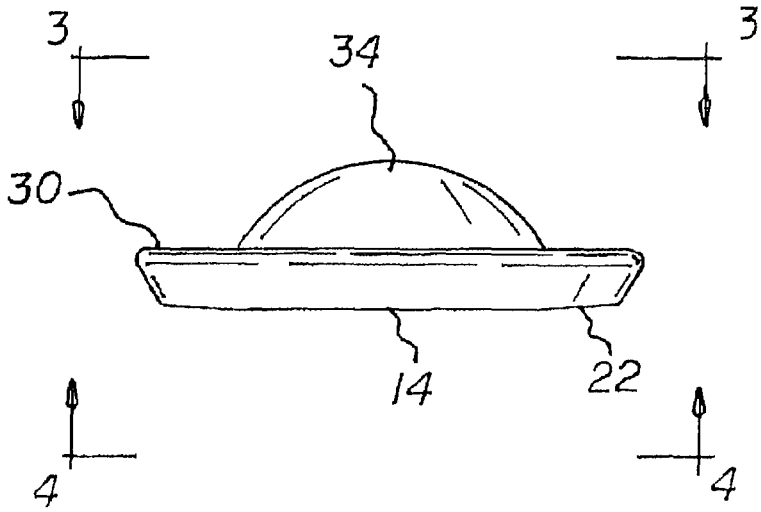
FIG. 2

FIG. 3
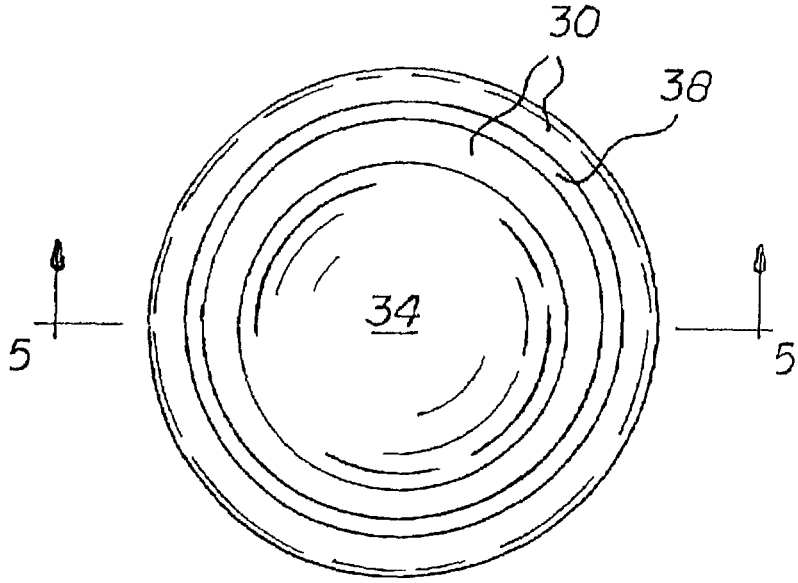
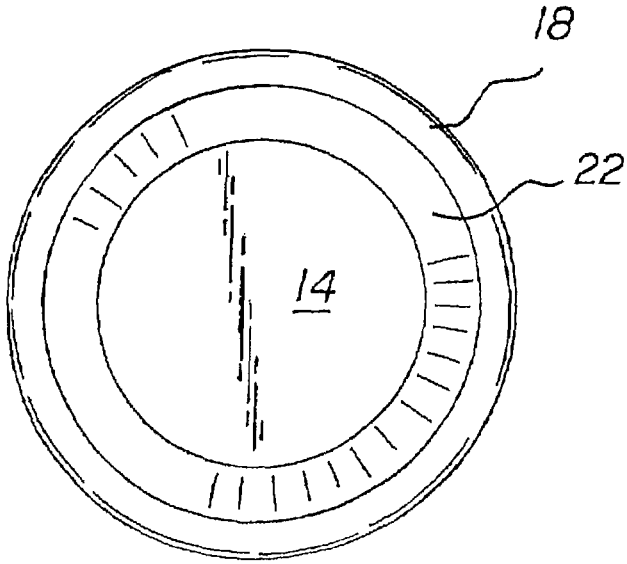
FIG. 4

FIG. 5
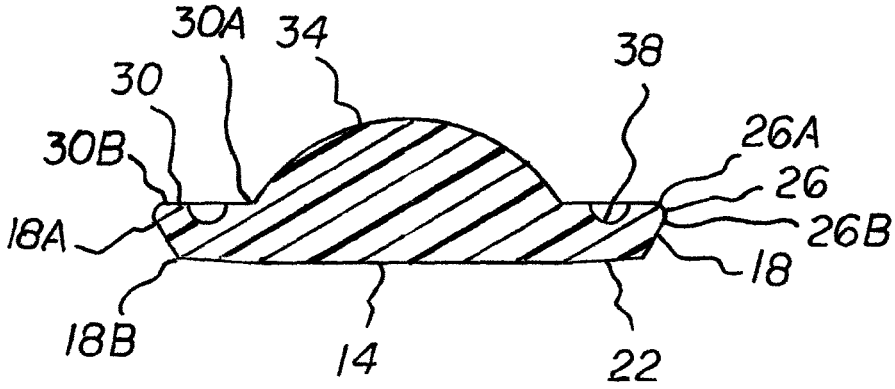
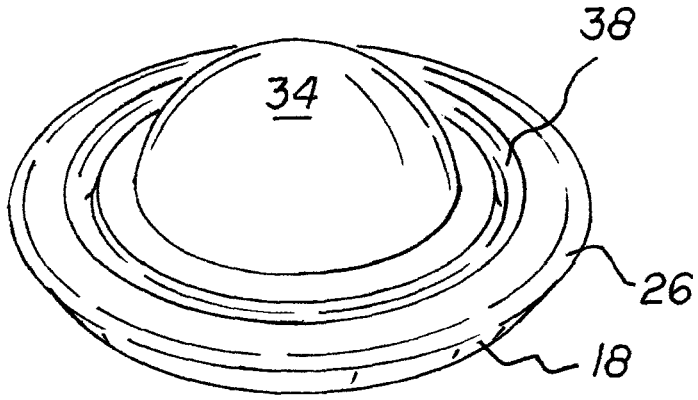
FIG. 6

SURF DISC SYSTEM

BACKGROUND OF THE INVENTION

Field of the Invention

The present invention relates to a surf disc system and more particularly pertains to being adapted to be thrown in a spinning motion for riding through water or skimming across the surface of the water, the throwing and riding and skimming being done in a safe and convenient and entertaining manner.

SUMMARY OF THE INVENTION

In view of the disadvantages inherent in the known types of surfing systems of known designs and configurations now present in the prior art, the present invention provides an improved surf disc system. As such, the general purpose of the present invention, which will be described subsequently in greater detail, is to provide a new and improved surf disc system and method which has all the advantages of the prior art and none of the disadvantages.

To attain this, the present invention essentially comprises a surf disc system. First provided is a planar bottom surface. The bottom surface has a circular periphery. The periphery of the bottom surface has a diameter of 7.38 inches plus or minus 10 percent. The bottom surface is in a base plane. The bottom surface and the system have a vertical central axis. The system is symmetric around the central axis.

A frusto-conical lower exterior surface is provided. The lower exterior surface has a circular lower edge. The lower edge is coupled to the periphery of the bottom surface. The lower exterior surface has a circular upper edge. The upper edge has a diameter. The diameter of the upper edge is greater than the periphery of the bottom surface. The lower exterior surface forms an angle with the base plane of 58 degrees plus or minus 10 percent.

Provided next is a frusto-conical rocker. The rocker is provided between the bottom surface and the lower edge of the lower exterior surface. The rocker extends out from the base plane at 3.7 degrees plus or minus 10 percent.

An upper exterior surface is provided next. The upper exterior surface has a semicircular cross section. The upper exterior surface has a circular lower edge. The lower edge is coupled to the upper edge of the lower exterior surface. The upper exterior surface has a circular upper edge. The upper edge has a diameter. The diameter of the upper edge is essentially equal to the diameter of the lower edge of the upper exterior surface. The upper exterior surface has a maximum diameter of 11.86 inches plus or minus 10 percent.

A planar top surface is provided. The top surface has an interior edge and an exterior edge. The exterior edge is coupled to the upper edge of the upper exterior surface. The top surface is provided parallel with the bottom surface. The top surface is spaced from the bottom surface by 1.40 inches plus or minus 10 percent.

Further provided is a hemispherical dome. The dome extends upwardly from the top surface for 2.0 inches plus or minus 10 percent. The dome has a lower periphery. The lower periphery of the dome is provided concentric with the exterior edge of the top surface. The lower periphery of the dome has a diameter of 7.00 inches plus or minus 10 percent. The dome is adapted to keep the system centrally weighted. In this manner the rocker is allowed to have full effect especially during windy conditions.

Provided last is an annular thumb-receiving recess. The annular recess is formed in the top surface essentially midway between the dome and the upper edge of the exterior surface. The annular recess has a radius of curvature of 0.44 inches plus or minus 10 percent.

The system is fabricated of a soft, lighter-than-water, elastomeric material. The soft, lighter-than-water, elastomeric material is chosen from the class of soft, lighter-than-water, elastomeric materials. The class of soft, lighter-than-water, elastomeric materials includes plastic and rubber, natural and synthetic, and blends thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved surf disc system which has all of the advantages of the prior art surfing systems of known designs and configurations and none of the disadvantages.

It is another object of the present invention to provide a new and improved surf disc system which may be easily and efficiently manufactured and marketed.

It is further object of the present invention to provide a new and improved surf disc system which is of durable and reliable constructions.

An even further object of the present invention is to provide a new and improved surf disc system which is susceptible of a low cost of manufacture with regard to both materials and labor, and which accordingly is then susceptible of low prices of sale to the consuming public, thereby making such surf disc system economically available to the buying public.

Even still another object of the present invention is to provide a surf disc system for being adapted to be thrown in a spinning motion for riding through water or skimming across the surface of the water, the throwing and riding and skimming being done in a safe and convenient and entertaining manner.

Lastly, it is an object of the present invention to provide a new and improved surf disc system having a planar bottom surface and parallel top surface with an upwardly extending hemispherical dome, an annular thumb recess formed in the top surface, and a frusto-conical rocker formed in the bottom surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a surf disc system constructed in accordance with the principles of the present invention, the system being shown riding through water or skimming across the surface of the water.

FIG. 2 is an enlarged side elevational view of the surf disc system of FIG. 1.

FIG. 3 is a plan view of the surf disc system taken along line 3-3 of FIG. 2.

FIG. 4 is a bottom view of the surf disc system taken along line 4-4 of FIG. 2.

FIG. 5 is a cross sectional view of the surf disc system taken along line 5-5 of FIG. 3.

FIG. 6 is a perspective view of the surf disc system of the prior Figures.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved surf disc system embodying the principles and concepts of the present invention and generally designated by the reference numeral 10 will be described.

The present invention, the surf disc system 10 is comprised of a plurality of components. Such components in their broadest context include a planar bottom surface, a lower exterior surface, an upper exterior surface, a planar top surface, a hemispherical dome, and a rocker. Such components are individually configured and correlated with respect to each other so as to attain the desired objective.

First provided is a planar bottom surface 14. The bottom surface has a circular periphery. The periphery of the bottom surface has a diameter of 7.38 inches plus or minus 10 percent. The bottom surface is in a base plane. The bottom surface and the system have a vertical central axis. The system is symmetric around the central axis.

A frusto-conical lower exterior surface 18 is provided. The lower exterior surface has a circular lower edge 18B. The lower edge is coupled to the periphery of the bottom surface. The lower exterior surface has a circular upper edge 18A. The upper edge has a diameter. The diameter of the upper edge is greater than the periphery of the bottom surface. The lower exterior surface forms an angle with the base plane of 58 degrees plus or minus 10 percent.

Provided next is a frusto-conical rocker 22. The rocker is provided between the bottom surface and the lower edge of the lower exterior surface. The rocker extends out from the base plane at 3.7 degrees plus or minus 10 percent.

An upper exterior surface 26 is provided next. The upper exterior surface has a semicircular cross section. The upper exterior surface has a circular lower edge 26B. The lower edge is coupled to the upper edge of the lower exterior surface. The upper exterior surface has a circular upper edge 26A. The upper edge has a diameter. The diameter of the upper edge is essentially equal to the diameter of the lower edge of the upper exterior surface. The upper exterior surface has a maximum diameter of 11.86 inches plus or minus 10 percent.

A planar top surface 30 is provided. The top surface has an interior edge 30A and an exterior edge 30B. The exterior edge is coupled to the upper edge of the upper exterior surface. The top surface is provided parallel with the bottom surface. The top surface is spaced from the bottom surface by 1.40 inches plus or minus 10 percent.

Further provided is a hemispherical dome 34. The dome extends upwardly from the top surface for 2.0 inches plus or minus 10 percent. The dome has a lower periphery. The lower periphery of the dome is provided concentric with the exterior edge of the top surface. The lower periphery of the dome has a diameter of 7.00 inches plus or minus 10 percent. The dome is adapted to keep the system centrally weighted. In this manner the rocker is allowed to have full effect especially during windy conditions.

Provided last is an annular thumb-receiving recess 38. The annular recess is formed in the top surface essentially midway between the dome and the upper edge of the exterior surface. The annular recess has a radius of curvature of 0.44 inches plus or minus 10 percent.

The system is fabricated of a soft, lighter-than-water, elastomeric material. The soft, lighter-than-water, elastomeric material is chosen from the class of soft, lighter-than-water, elastomeric materials. The class of soft, lighter-than-water, elastomeric materials includes plastic and rubber, natural and synthetic, and blends thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A surf disc system (10) adapted to be thrown in a spinning motion the system comprising, in combination:

a planar bottom surface (14) having a circular periphery with a diameter of 7.38 inches plus or minus 10 percent, the bottom surface being in a base plane, the bottom surface and the system having a vertical central axis, the system being symmetric around the central axis;

a frusto-conical lower exterior surface (18) having a circular lower edge (18B) adjacent to the periphery of the bottom surface, the lower exterior surface having a circular upper edge (18A) with a diameter greater than the periphery of the bottom surface, the lower exterior surface forming an angle with the base plane of 58 degrees plus or minus 10 percent;

a frusto-conical rocker (22) formed between the bottom surface and the lower edge of the lower exterior surface, the rocker extending out from the base plane at 3.7 degrees plus or minus 10 percent;

an upper exterior surface (26) having a semicircular cross section with a circular lower edge (26B) adjacent to the upper edge of the lower exterior surface, the upper exterior surface having a circular upper edge (26A) with a diameter essentially equal to the diameter of the lower edge of the upper exterior surface, the upper exterior surface having a maximum diameter of 11.86 inches plus or minus 10 percent;

a planar top surface (30) having an interior edge (30A) and an exterior edge (30B), the exterior edge adjacent to the upper edge of the upper exterior surface, the top surface being parallel with the bottom surface, the top surface being spaced from the bottom surface by 1.40 inches plus or minus 10 percent;

a hemispherical dome (34) extending upwardly from the top surface for 2.0 inches plus or minus 10 percent, the dome having a lower periphery concentric with the exterior edge of the top surface, the lower periphery of the dome having a diameter of 7.00 inches plus or minus 10 percent, the dome adapted to keep the system centrally weighted for allowing the rocker to have full effect especially during windy conditions; and an annular thumb-receiving recess (38) formed in the top surface essentially midway between the dome and the upper edge of the exterior surface, the annular recess having a radius of curvature of 0.44 inches plus or minus 10 percent;

the system being fabricated of a soft, lighter-than-water, elastomeric material.

* * * * *